United States Patent [19]

Tamada et al.

[11] 4,089,319

[45] May 16, 1978

[54] HOT BLAST TYPE OVEN

[76] Inventors: Kazumi Tamada; Sueo Mizuno; Tadayoshi Takase; Masahiko Koumura; Shinichi Soma, all of c/o Rinnai Kabushiki Kaisha, of 2-26, Fukuzumi-cho, Nakagawa-ku, Nagoya-shi, Aichi-ken, Japan

[21] Appl. No.: 751,972

[22] Filed: Dec. 17, 1976

[30] Foreign Application Priority Data

Dec. 22, 1975 Japan ..... 50-151888

[51] Int. Cl.[2] ..... F24C 15/32

[52] U.S. Cl. ..... 126/21 A; 126/273 R; 236/15 A

[58] Field of Search ..... 126/21 R, 21 A, 192, 126/197, 198, 273 R, 39 C, 273 A, 19; 431/255, 43, 132, 135; 236/15 A

[56] References Cited

U.S. PATENT DOCUMENTS

| | | | |
|---|---|---|---|
| 3,032,028 | 5/1962 | Pearce et al. | 126/21 A |
| 3,469,568 | 9/1969 | Torrey et al. | 126/197 X |
| 3,548,804 | 12/1970 | Faehling et al. | 126/197 X |
| 3,704,703 | 12/1972 | Takase et al. | 126/39 C |
| 3,707,145 | 12/1972 | Antsberger et al. | 126/21 A |
| 3,991,737 | 11/1976 | Fabbro | 126/21 A |

*Primary Examiner*—Edward G. Favors
*Attorney, Agent, or Firm*—Haseltine, Lake & Waters

[57] ABSTRACT

A hot blast type oven comprising an outer casing defining a heating chamber adapted to receive foodstuff to be cooked and having a front door for opening and closing the heating chamber. A main burner serves for producing hot gases sent to the heating chamber by a blower. A gas control section including an operation handle controls the supply of gas to the main burner and to a pilot burner adjacent thereto. An electrical control section serves for controlling the main blower and an ignition device for the pilot burner. The gas control section and the electrical control section are constituted as respective units coupled together and detachably mounted for mutual operation. The control sections are operated in accordance with movement of the door such that the operation handle is locked when the door is closed and lighting of the pilot burner can be achieved only by opening the door and displacing the operation handle. After lighting of the pilot burner and closure of the door, gas supply to the main burner and energization of the blower are effected. Thereafter, if the door is opened the blower is deactuated and the gas supply to the main burner is interrupted.

7 Claims, 13 Drawing Figures

58
60
94
100
101
74
9
59
33
31
32
69
77
7
37
VII
VII
78
107
57
A
65
64
109
108
106
72
36
B
51
10
11
46.47

33
60
90
88
74
75
76
58
9
59
32
65
A
57
78
107
43
45
72
108
51
36
B
39
106
46
47

33
63
58
62
90
73
60
77
31
61
89
32
88a
88
74
75
76
59
9
7

HOT BLAST TYPE OVEN

FIELD OF THE INVENTION

This invention relates to a cooking oven of hot air blast type.

BACKGROUND

In general, cooking ovens of the above type effect cooking with heat by blowing the hot gases of a heat source onto the foodstuff to be cooked by the action of a blower. Therefore, the oven is advantageous in that the cooking time is greatly shortened by the blowing of the hot air thereon and thereby the foodstuff to be cooked is prevented from being dried unnecessarily, and accordingly any change in taste thereof can be avoided. However, the oven is disadvantageous in that it requires a complicated procedure for the operation thereof such as the ignition operation of the burner in the limited interior space of the oven and the safety thereof during the heating operation with air blowing. For simplfying such complicated operations, an oven has been proposed in which the operating sections and the respective operational control devices are arranged to be operated separately, but the oven is also deficient in that it requires much effort in the connection between the various parts of the gang mechanism therefor and complicated means for adjustment thereof are needed.

SUMMARY OF THE INVENTION

An object of the invention is to provide an oven in which the above deficiencies are eliminated and wherein the parts related to gas operation and the parts related to electrical operation are respectively grouped and formed into respective units, and both units are interconnected that the mutual operation thereof is automatically ganged and the mounting of the two units on the oven body is simplified and the maintenance thereof facilitated. Also, each unit can be highly accurate and stable because the manufacture thereof can be made in its specialized field.

DETAILED DESCRIPTION

Figure 3:
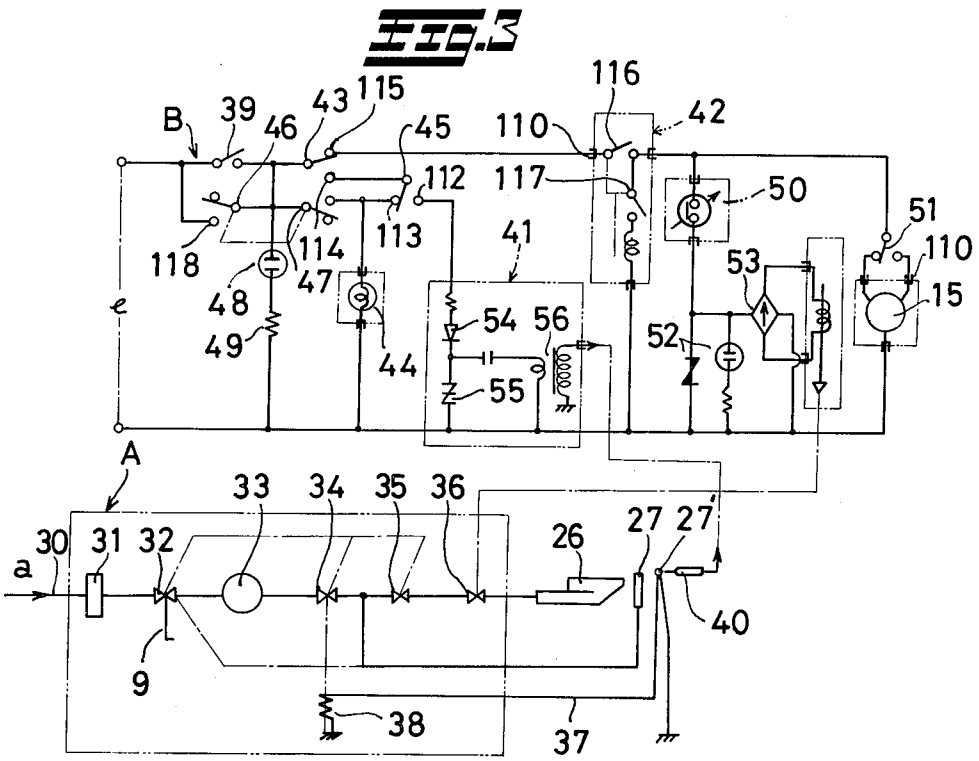
FIG. 3 is a circuit diagram of a gas control section and an electric control section of the oven.
Figure 2:
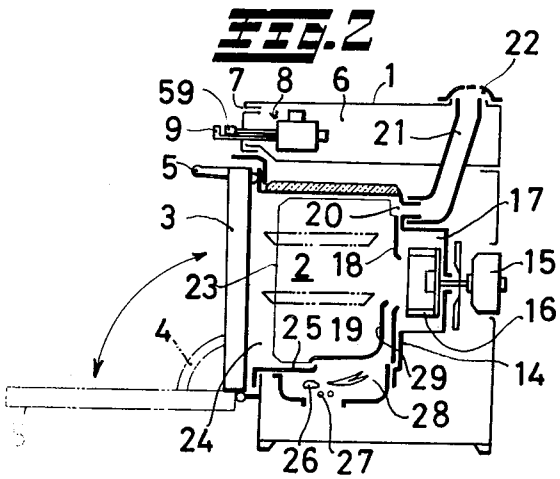
FIG. 2 is a sectional side view of the oven.
Figure 1:
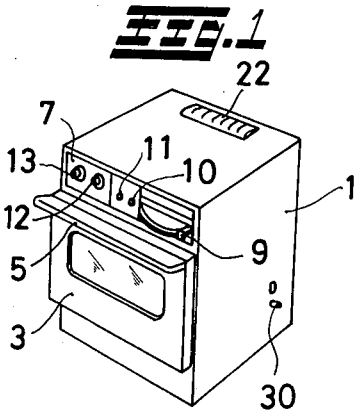
FIG. 1 is a perspective view of one embodiment of the oven according to this invention.

The oven according to the invention comprises an outer casing 1 containing a heating chamber 2. A door 3 is hinged at its lower edge to the front surface of the casing and the door 3 can be opened and maintained horizontally by means of a stay 4. Numeral 5 denotes a handle for operation of the door 3.

A control panel 7 is disposed at the front surface of a space chamber 6 formed, by a partition, in an upper region of the outer casing 1. Mounted at the front of panel 7 are an operation handle or lever 9 for a control apparatus 8 provided within the chamber 6, switches 10, 11 and control knobs 12, 13 respectively for a temperature control device and a timer.

A rear wall 14 of the heating chamber 2 is formed with a blower chamber 17 having a blower 16 therein driven by an electric motor 15, the front surface of the blower chamber 17 being in communication with the heating chamber 2 through a ventilation window 19 provided in a partition plate 18.

An exhaust pipe 21 connected to an exhaust opening 20 located at the rear upper portion of the heating chamber 2 is in communication with an exhaust outlet 22 in a top plate of the outer casing 1.

The partition plate 18 is provided at each of its side portions with a side plate 23 projecting forwardly so as to form a ventilation space between the side plate and each side wall of the heating chamber 2, and the ventilation space is in communication with a ventilation space formed between the partition plate 18 and the rear wall 14. Another ventilation space 24 is formed between the front end of each side plate 23 and the inner surface of the door 3, so that the air flow produced by the blower 16 can be fed through both the side and front ventilation spaces into the heating chamber 2 at the front thereof.

A combustion chamber 28, for a heating burner 26 and a pilot burner 27 and elements associated therewith, is formed below a bottom plate 25 of the heating chamber 2, and a hot gas duct 29 passes through an upper portion of the chamber into communication with the heating chamber 2 so as to open below the ventilation window 19 of the partition plate 18. A combustion air intake opening is formed in a bottom of the combustion chamber 28.

In the hot blast type oven as described above, the construction of the gas control section A for the gas burner and that of an electrical control section B for the blower and others will be explained with reference to FIG. 3.

The gas control section A is so contructed that supply gas *a* from the exterior passes through a filter 31 from a connecting opening 30 and reaches the heating burner 26 through a first valve 32, a gas governor 33, a second valve 34, a third valve 35 and a fourth valve 36, and the gas is also supplied to the pilot burner 27 by being diverted from a portion between the second valve 34 and the third valve 35, the second valve 34 serving as a pilot safety valve by a construction in which a lead wire 37 for conducting electromotive power of a thermocouple 27′ heated by being brought into contact with a part of a flame of the pilot burner 27 is connected to an electromagnet 38 for holding the valve 34 open.

The electrical control section B is so constructed that a power source *e* is connected through a power switch 39 to a first changeover switch 43 which is selectively connected to either a high voltage generator 41 for effecting a spark discharge from an ignition electrode 40 for the pilot burner 27 or a timer 42. A circuit connected to the high voltage generator 41 is provided with a second changeover switch 45 for selectively connecting a lamp 44 in the heating chamber 2, and a circuit for the lamp 44 is provided with two gang-switches 46, 47 arranged in parallel with the power switch 39, and a power source indication lamp 48 and a resistance 49 are connected to the circuit.

The electric motor 15 for the blower 16 and a temperature control device 50 are connected in parallel with the timer 42, and a changeover switch 51 for changing over to either high or low speeds is connected in series with the electric motor 15, and the fourth valve 36 comprising an electromagnetic valve in the gas control section A is connected to the temperature control device 50 through a rectifier 53 having a protection circuit 52. The high voltage generator 41 comprises a diode 54, a switch diode 55, and a booster coil 56.

Figure 5:
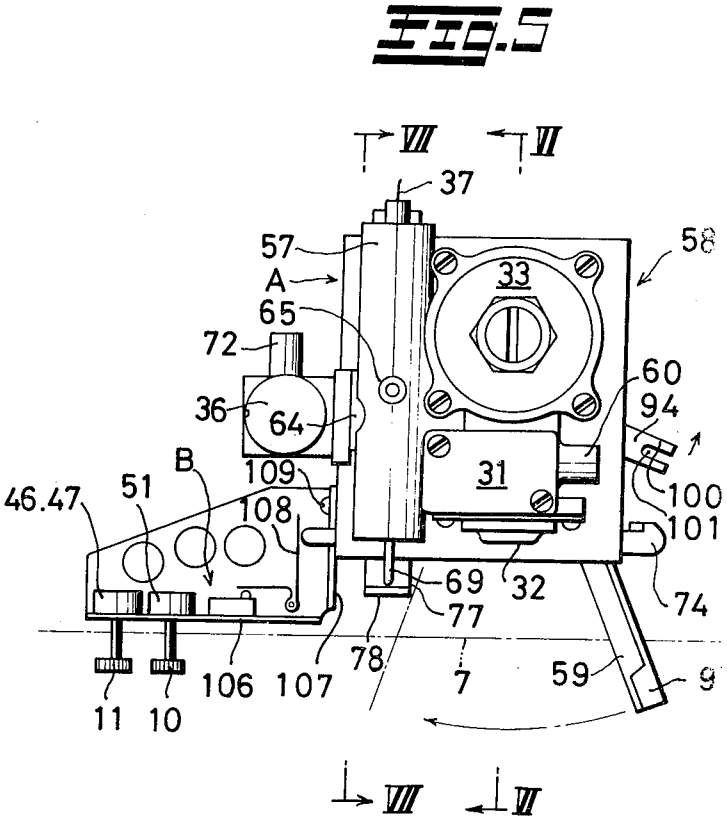
FIG. 5 is a top plan view thereof.
Figure 4:
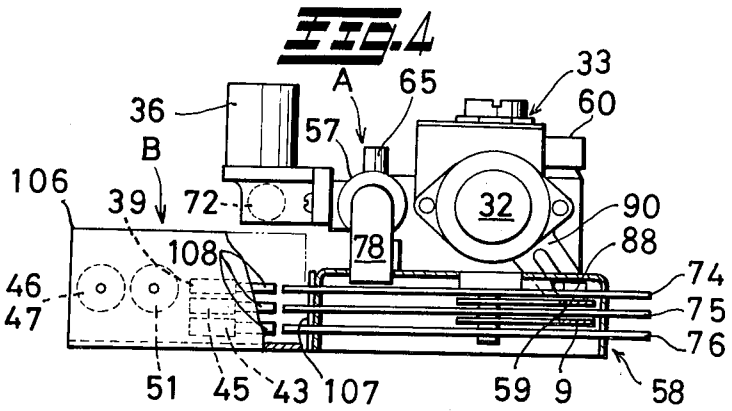
FIG. 4 is a front view of the combination of the gas control section and the electric control section.
Figure 6:
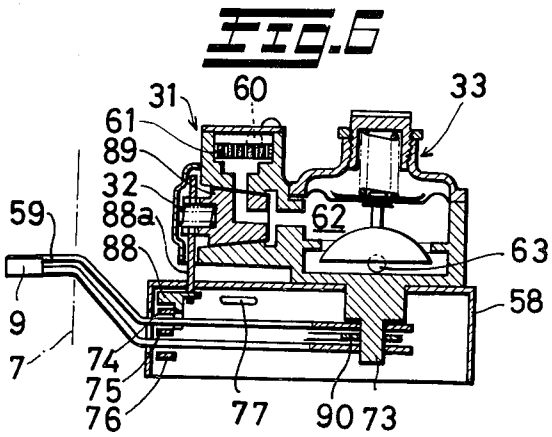
FIGS. 6 and 7 are sectional views taken along lines VI — VI and VII — VII respectively in FIG. 5.

The foregoing gas control section A is disposed in the upper portion of the outer casing 1 as the control apparatus 8, and the detailed construction thereof will be described with reference to FIGS. 4, 5 and 6.

The filter 31, the first valve 32 and the gas governor 33 are integrally combined together as an assembly and the second valve 34 and the third valve 35 together with the electromagnet 38 of the second valve 34 are incorporated in a unitary valve housing 57 which is integrally connected to the foregoing gas governor 33, and these are attached as a unit to a base member 58.

The base member 58 supports with the operation handle 9, a second operation handle 59 arranged to be moved therewith, and a gang mechanism for coupling these handles together.

Figure 10:
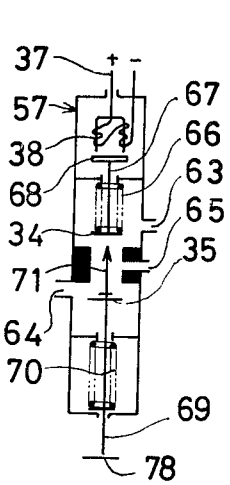
FIGS. 9 and 10 are diagrammatic illustrations showing the operation thereof.
Figure 9:
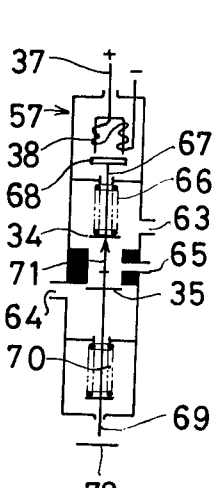
Figure 8:
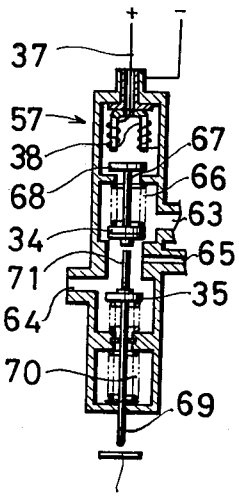
FIG. 8 is a sectional plan view of a valve housing portion thereof.
Figure 7:
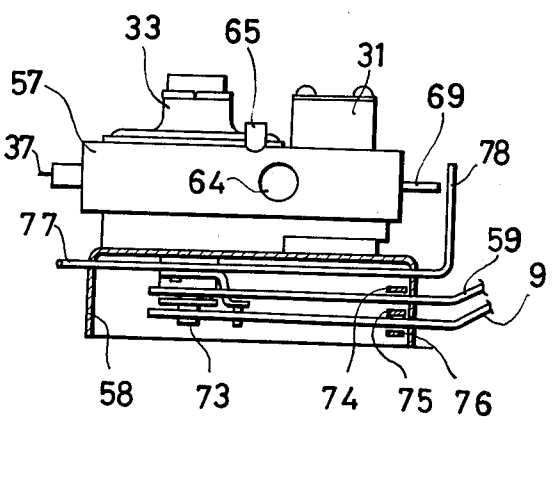

In greater detail, the filter 31 has on one side a connecting opening 60 for connection with the supply gas inlet *a* and the interior of the opening is in communication with the first valve 32 through a filter member 61, and is further in communication through a pressure control chamber 62 of the gas governor 33 and a gas passage 63 thereof, with the valve housing 57. As shown in FIGS. 8 to 10, the valve housing 57 is so constructed that the gas passage 63 is in communication with a gas outlet 64 through the second valve 34 and the third valve 35, and it has at a portion between the second valve 34 and the third valve 35 a pilot gas outlet 65 connected to the pilot burner 27. The second valve 34 is urged by a spring 66 so as to be ordinarily closed, and an armature 68 is attached to an end portion of a valve rod 67 thereof and faces the electromagnet 38 connected to the thermocouple 36 on the pilot burner 27.

A valve rod 69 of the third valve 35 is urged by a spring 70 so that the rod 69 projects from valve housing 57 and the valve 35 is ordinarily in its open condition, and a rear end 71 of the valve rod 69 is opposite the second valve 34. The fourth valve 36 is attached to the gas outlet 64 and the valve 36 is constituted as an electromagnetic valve, and thus in this case an outlet 72 of the fourth valve 36 becomes the gas outlet.

Figure 11:
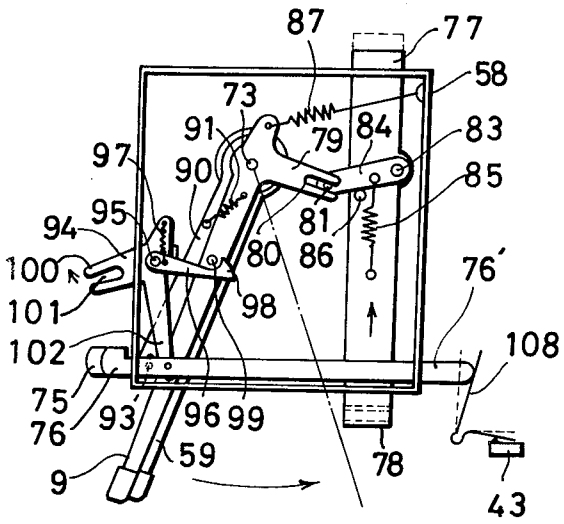
FIG. 11 is a bottom view of the gas control section.

The operation handle 9 is pivotally supported on a supporting shaft 73, and switch operation levers 74, 75, 76 disposed transversely across the handle 9 are mounted loosely and slidably in the base member 58 such that they pass laterally through the base member 58. Additionally, a slidable plate 77 is slidably mounted just below the valve housing 57 in the base member 58 such that it passes longitudinally through the base member 58, and its front end 78 is bent upwards so as to face the projecting end of the valve rod 69 of the third valve 35. As shown in FIG. 11 the slidable plate 77 is arranged so that an arm 84 pivotally attached thereto at 83 and an arm 79 integral with the operation handle 9 are in engagement with one another through a slit 80 in arm 79 and a pin 81 on arm 84. The arm 84 is urged forwardly by a spring 85 and is engaged by a stopper 86.

The operation handle 9 is urged to its initial rest position by a spring 87 connected to the base member 58.

The second operation handle 59, pivotally supported on the same shaft 73 as the operation handle 9, is connected through a gang member 88 provided at its front portion with an arm member **88*a* secured to a cock 89 (shown in FIG. 6) of the first valve 32, so that the cock 89 may be turned by operation of the second operation handle 59 and also at that time the switch operation lever 74 connected to the handle 59 through the gang member 88** is slidably moved.

An operation lever 90, loosely mounted on the same shaft 73 as the first operation handle 9, is connected to the handle 9 through a spring 91, so that the operation lever 90 may follow in the turning direction of the handle 9. The operation lever 90 is also arranged to be in engagement at its front end with a pin 93 of the switch operation lever 75, so that by turning the handle 9 the switch operation lever 75 slides through the action of the operation lever 90 and after this operation the handle 9 may turn further against the action of the spring 91.

Figure 13:
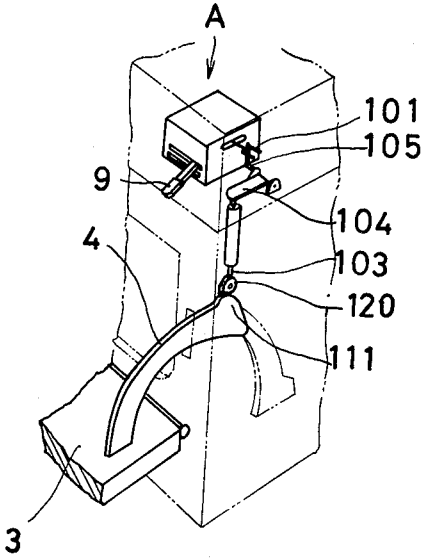
FIG. 13 is a perspective view of a part of the oven with the door opened.
Figure 12:
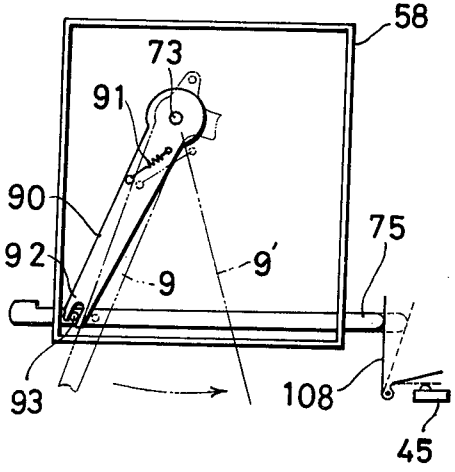
FIG. 12 is a bottom view of a part thereof showing its operation thereof.

An anchor plate 94 in the form of a two armed lever is pivotally mounted on a shaft 95 in the base member 58, and the plate 94 is connected through a spring 97 to an anchor 96 loosely mounted on the shaft 95. A hook 98 on the front end of the anchor 96 is in engagement with a pin 99 on the operation handle 9. One of the arms 100 of the anchor plate 94 projects outside the base member 58 and is formed at its front end with an engaging groove 101. The other arm 102 of the plate 94 is pivotably connected to the switch operation lever 75. The engaging groove 101 of the arm 100 of the anchor plate 94 is in engagement, as shown in FIG. 13, with a rotary shaft 105 of a gang member 104 which is moved with the stay 4 of the door 3, so that when the door 3 is closed the hook 98 on the anchor 96 is brought into engagement with the pin 99 so as to prevent operation of the operation handle 9.

As for the construction mechanism of the electric control section B, various parts such as the switch and other parts are disposed on printed wire base plate 106, and the switches 46, 47 are in the form of a gang switch and the control knob 11 thereof and the control knob 10 of switch 51 are disposed on the front surface.

The printed wire base plate 106 is secured at an attaching portion 107 to the base member 58 of the gas control section A by means of a screw 109, and the switches 39, 33, 45 are arranged to face respective actuators 108 of the switch operation levers 74, 75, 76 of the gas control section A.

The electric motor 15, the timer 42 and others which are disposed separately from the printed wire base place 106 are detachably connected through respective terminals 110.

The gas control section A and the electrical control section B thus constructed are interconnected integrally, whereby the operation handle 9, the second operation handle 59 and the control knobs 10, 11 protrude at the front of the outer casing 1 so that operation thereof from the front is possible. The gang member 104 of the elevating member 103 moving with the stay 4 of the door 3 and the engaging groove 101 of the anchor plate 94 are brought into engagement with one another, and the temperature control device 50 and the timer 42 are disposed on the control apparatus 8, and the operation knobs 12, 13 thereof are positioned at the front of the control panel 7.

The oven of the above construction is first prepared for operation by ignition of the pilot burner 27. The ignition of the pilot burner 27 is effected by operation of the operation handle 9. However, under the condition that the door 3 is closed, as shown in FIG. 11, the anchor 96 is in its engaging condition with the pin 99 of the handle 9, so that operation of the handle 9 is impossible and accordingly ignition of the pilot is impossible if the door 3 is closed. If the door 3 is opened, then due to displacement of the stay 4, its rear projection 111 pushes a roller 120 on the lower end of the elevating member 103 upwardly to turn the gang member 104, whereby through its rotary shaft 105 the anchor plate 94 is turned in the direction shown by the arrow in FIG. 11 and thereby the anchor plate 96 is disengaged from the pin 99 and the handle 9 is released from its locked position. Simultaneously with the operation of the anchor plate 94, the switch operation lever 76 is moved by the side member 102 of the anchor plate 94, so that the switch 43 is changed over 114 and thus the high voltage generator 41 is ready for being energized. Additionally, by turning of the handle 9, through the arm 97 integral therewith and the arm 84, the slidable plate 77 is moved in the direction shown by an arrow in FIG. 11, whereby the front end 78 thereof pushes the valve rod 69 inwards and thereby, as shown in FIG. 9, the third valve 35 is closed and the gas passage to the gas outlet 64 is closed. At the same time, the second valve 34 is pushed inwards to open position by the valve rod 69. The armature 68 of the valve rod 67 thereof is brought into pressure contact with the electromagnet 38, and as a result the gas passage 63 opened thereby is brought into communication with the gas passage 65 to the pilot burner 27. At the same time, furthermore, the operation lever 90 following the handle 9 moves the switch operation lever 75 in contact therewith and thereby the switch 45 is changed over to a contact 112, whereby the high voltage generator 41 is connected to the power source. Upon further turning of the operation handle 9, while stretching the spring 91, it reaches the position 9' shown in chain-dotted lines in FIG. 11. With this turning operation, the second operation handle 59 is turned simultaneously, whereby the cock 89 of the first valve 32 is turned through the gang member 88 and the arm member 90 so as to open the gas passage, and at the same time the switch 39 is closed by the switch operation lever 74 whereby by the co-operation of switch 39 with the foregoing changeover of the switch 45, the high voltage generator 41 is energized and as a result a spark discharge is effected at the ignition electrode 40 and the pilot burner 27 is ignited. By such ignition, the thermocouple 27' is heated and its electromotive power acts to energize the electromagnet 38 and the armature 68 on the front end of the valve rod 67 of the second valve 34 is attracted thereby, so that the second valve 34 previously opened is kept in this condition.

If the operation force acting on the handle 9 is removed after the pilot burner 27 is ignited as above, the handle 9 is returned to the starting position by the pulling force of the spring 87 and thereby the slidable plate 77 is returned to the original position, so that as shown in FIG. 10, the valve rod 69 is returned by the action of the spring 70 to the original position, so that the third valve 35 is opened and the gas outlet 64 is opened. In this condition, the second valve 34 is still kept open and at this stage the fourth valve 36 is still kept closed, so that gas supply to the heating burner 26 is not effected. Additionally, by the foregoing return movement of the handle 9, the switch 45 is changed over to contact 113 and thereby the operation of the high voltage generator 41 is stopped and the spark discharge of the ignition electrode 40 ends.

After the ignition operation of the pilot burner 27 has been completed and foodstuff to be cooked is placed in the heating chamber 2 and the door 3 is closed, or the door 3 is closed for pre-heating in the heating chamber 2 to a predetermined temperature prior to the cooking, the anchor plate 94 is turned, due to displacement of the stay 4, in a direction reverse to that shown by the arrow through the elevating member 103 and the gang member 104, so that the switch operation lever 76 connected to the side member 102 of the anchor plate 94 is moved back and the switch 43 is changed over from contact 114 to contact 115, resulting in connecting the timer 42 to the power source. If timer switch 116 is closed, the electric motor 15 is energized and thereby the blower 16 is operated, and at the same time the rectifier 53 is energized through the temperature control device 50 and thereby the fourth valve 36 comprising the electromagnetic valve is opened and gas supply to the heating burner 26 is effected. By means of the flame of the pilot burner 27 previously ignited, the gas is ignited and hot gases produced by the combustion are sucked by the blower 16 into the blower chamber 17 through the hot blast duct 29 and the hot gases are fed into the heating chamber 2 through the front ventilation spaces 24 after passing through the lateral ventilation spaces between the partition plate 18 and the opposite side plates 23. The hot gases passed through the heating chamber 2 are returned to the blower chamber 17 through the ventilation window 19 and are again circulated while fresh hot gases are added, whereby cooking is carried out. A part of the hot gases sent into the heating chamber 2 after use for cooking are discharged to the exterior through the exhaust opening 20, the exhaust pipe 21, and the exhaust outlet 22.

A temperature sensing element (not illustrated) is provided at a suitable location in the heating chamber 2 and the temperature control device 50 is automatically thereby, so that when the temperature in the interior of the heating chamber 2 reaches a predetermined value, the electric circuit to the fourth valve 36 is opened and thereby the gas supply to the heating burner 26 is stopped, and when the temperature in the heating chamber 2 is lowered below the predetermined temperature, the electric circuit for the fourth valve 36 is closed and the heating burner 26 is supplied with gas which is ignited. Thus, the temperature control is effected automatically. If, additionally, the timer 42 is given a time setting, a time switch 117 is opened after passage of the set time, whereby the timer switch 116 is opened and the fourth valve 36 is closed and the electric motor 15 is stopped and thus the heating operation is ended and there remains only the flame of the pilot burner 27. Accordingly, if the timer switch 116 is closed for starting the heating again, an occasion demands, heating by burning at the heating burner 26 is started again.

If the door 3 is opened to observe the condition of the foodstuff during the cooking, the stay 4 is moved therewith and the switch 43 is changed over to the contact 114, whereby the electric motor 15 is stopped and the fourth valve 36 is closed, so that there is not brought about the danger that the hot air blast is discharged to the exterior through the front opening at the open door 3. In this case, by the changeover operation of the switch 43, the lamp 44 in the heating chamber 2 is lighted through the switch 45, and the lamp 44 can be lighted and extinguished freely by changing over the manually operated switch 46.

With the foregoing construction, the oven of the invention has the following various advantages.

1). The ignition operation of the pilot burner 27 becomes possible only when the door 3 is opened, so that any danger of explosion caused by ignition-miss or the like is prevented.

2). The gas passage arranged to be opened by the ignition operation is provided with the third valve 35 which closes the gas passage to the heating burner 26 only by the ignition operation, and thus the gas passage to the heating burner 26 is closed in redundancy and the degree of safety is increased.

3). When the door is opened during cooking, the gas supply to the heating burner 26 is automatically stopped and the electric motor 15 is stopped, so that the danger of blowing out of the hot air blast is eliminated.

4). When the burning operation has stopped during cooking for some reason, such as electric power failure or the like, the apparatus does not operate again unless a starting operation is effected by opening the door, so that there is no danger of an imcomplete operation.

5). The gas control section A and the electrical control section B are each formed as a unit, so that the manufacture thereof is more efficient and a high precision product can be obtained easily and at a low price.

6). The forgoing units can be simply detached, so that maintenance thereof becomes simple and easy.

7). The gas control section A and the electrical control section B are assured of their mutual relationship by being combined together, so that they can be reliably operated.

8). In the case where different operations are needed, only the electrical control section is selectively prepared as a different circuit and thus the apparatus can be simply reprogrammed.

What is claimed is:

1. A hot blast type oven comprising a casing defining a heating chamber for receiving foodstuff to be cooked, a door pivotally mounted on said casing to be opened and closed, main burner means for producing hot gases for heating said chamber, pilot burner means adjacent said main burner means, ignition means for igniting the pilot burner means, blower means for supplying the hot gases from said burner means to said heating chamber, a gas control section including an operation handle for controlling the supply of gas to said main burner means and to said pilot burner means, an electrical control section for controlling said main blower means and said ignition means for the pilot burner means, said gas control section and said electrical control section being constituted as respective units, means detachably connecting these two units together in a combined relative position so that they can be mutually operated, and means coupling said control sections to one another and said door for locking said operation handle when the door is closed and for releasing said handle when the door is opened to permit ignition of said ignition means and lighting of said pilot burner means by operation of said handle, said electrical control section including a timer switch means operatively associated with the coupling means for selectively controlling continuous or limited time of energization of said blower means and gas supply to said main burner means after lighting of the pilot burner means and closure of said door.

2. A hot blast type oven as claimed in claim 1 wherein said electrical control section comprises a temperature control device for setting the temperature in the heating chamber, said gas control section comprising a filter, a first valve operable by said operation handle, a gas governor, a second valve serving as a pilot safety valve, a third valve closed only during a starting operation in which the ignition means is ignited and the pilot burner means is lit, and a fourth valve opened and closed in response to said temperature control device connected in series between a gas inlet and a gas outlet, said second and third valves being axially disposed with a pilot gas discharging opening provided between said valves, said second and third valves as well as said first and second valves being combined together as a unit, a base member supporting said unit, said third valve including a valve rod projecting outside of said unit, a slidable plate loosely mounted in the base member and coupled for movement with the operation handle, said operation handle being pivotally supported on the base member, said valve rod of said third valve being in engagement with said slidable plate, a second operation handle pivotally mounted coaxially with the first said operation handle to be operated integrally therewith in the direction of the starting operation of the handle, said second operation handle being engageable with said first valve, and a spring acting on the main operation handle to return the same automatically when the operation force applied thereto is removed after the starting operation while the second operation handle remains in its operating position and may be returned manually.

3. A hot blast type oven as claimed in claim 2 wherein said coupling means comprises an anchor plate pivotably mounted relative to said gas control section and including a projection portion extending from said unit for being displaced upon opening and closing of said door, and an anchor pivotably mounted on said anchor plate and operatively positioned to lock said operation handle when the door is closed and to release said handle when the door is opened.

4. A hot blast type oven as claimed in claim 3 wherein said projection portion has a slot and said coupling means further comprises a pin engaged in said slot and undergoing movement during opening and closing of said door.

5. A hot blast type oven as claimed in claim 3 wherein said has control section further comprises a hollow base member pivotably supporting said anchor plate, three switch operation levers mounted for horizontal slidable movement in said base member and controlling operation of said electrical control section, the first of said levers being coupled for slidable movement upon operation of said first operation handle, the second of said levers being coupled for slidable movement upon operation of said second operation handle, and the third of said levers being coupled to said anchor plate for undergoing slidable movement upon operation thereof.

6. A hot blast type oven as claimed in claim 5 wherein said electric control section comprises a unit including a printed wire base plate detachably mounted relative to the switch operation levers of said gas control section for operation thereby.

7. A hot blast type oven as claimed in claim 6 wherein said electrical control section further comprises a lamp in the heating chamber, a time switch for said timer means, a first changeover switch operated by said first operation handle such that in the initial position of said handle it is connected to said lamp and in the operative position of the handle for ignition and lighting of the pilot burner means it is connected to an ignition operation circuit, a power switch operated by said second operation handle so as to be opened in the initial position of said second handle and be closed in the displaced position thereof, and a second changeover switch connected to a common terminal of the first changeover switch and connected in series with said power switch when the door of the heating chamber is open, but connected to said timer switch when the door is closed, and a driving motor for said blower means connected in parallel with the fourth valve, said fourth valve being connected in series with the temperature control device to an output side of the timer switch of the timer means and a manual switch for the lamp independent from the second changeover switch.

* * * * *